US012163289B2

(12) United States Patent
Turkki et al.

(10) Patent No.: US 12,163,289 B2
(45) Date of Patent: Dec. 10, 2024

(54) COATING STRUCTURE, SHEET-LIKE PRODUCT AND ITS USE

(71) Applicant: Kemira Oyj, Helsinki (FI)

(72) Inventors: Tarja Turkki, Helsinki (FI); Sami Puttonen, Helsinki (FI); Helena Peuranen, Espoo (FI); Mari Ojanen, Espoo (FI); Erland Hermansson, Helsinki (FI); Anneli Lepo, Espoo (FI)

(73) Assignee: Kemira Oyj, Helsinki (FI)

( * ) Notice: Subject to any disclaimer, the term of this patent is extended or adjusted under 35 U.S.C. 154(b) by 945 days.

(21) Appl. No.: 17/059,483

(22) PCT Filed: Jun. 19, 2019

(86) PCT No.: PCT/FI2019/050478
§ 371 (c)(1),
(2) Date: Nov. 30, 2020

(87) PCT Pub. No.: WO2019/243671
PCT Pub. Date: Dec. 26, 2019

(65) Prior Publication Data

US 2021/0214894 A1 Jul. 15, 2021

(30) Foreign Application Priority Data

Jun. 20, 2018 (FI) ..... 20185555

(51) Int. Cl.

| | |
|---|---|
| ***D21H 19/82*** | (2006.01) |
| ***B65D 65/42*** | (2006.01) |
| ***D21H 19/38*** | (2006.01) |
| ***D21H 19/54*** | (2006.01) |
| ***D21H 19/58*** | (2006.01) |
| ***D21H 19/60*** | (2006.01) |
| ***D21H 27/10*** | (2006.01) |

(52) U.S. Cl.
CPC ..... *D21H 19/822* (2013.01); *B65D 65/42* (2013.01); *D21H 19/385* (2013.01); *D21H 19/54* (2013.01); *D21H 19/58* (2013.01); *D21H 19/60* (2013.01); *D21H 27/10* (2013.01)

(58) Field of Classification Search
CPC .... D21H 19/822; D21H 19/385; D21H 19/54; D21H 19/58; D21H 19/60; D21H 27/10; B65D 65/42
See application file for complete search history.

(56) References Cited

U.S. PATENT DOCUMENTS

| | | | | |
|---|---|---|---|---|
| 5,776,619 | A | 7/1998 | Shanton | |
| 5,925,722 | A * | 7/1999 | Exner | C08F 285/00 527/311 |
| 6,666,807 | B2 * | 12/2003 | Codet | C23C 4/00 29/895.32 |
| 6,740,373 | B1 | 5/2004 | Swoboda | |
| 2004/0241475 | A1 | 12/2004 | Morabito | |
| 2017/0327669 | A1 * | 11/2017 | Ng | A61F 6/04 |

FOREIGN PATENT DOCUMENTS

| | | | | |
|---|---|---|---|---|
| CA | 2835273 | A1 | 12/2012 | |
| CA | 2835725 | A1 | 12/2012 | |
| CN | 103547450 | A | 1/2014 | |
| CN | 103547735 | A | 1/2014 | |
| CN | 103975107 | A | 8/2014 | |
| EP | 1596003 | A1 | 11/2005 | |
| JP | 2012172277 | A | 9/2012 | |
| RU | 2296786 | C2 | 4/2007 | |
| RU | 2528639 | C2 | 9/2014 | |
| WO | 2010070205 | A1 | 6/2010 | |
| WO | 2013083504 | A1 | 6/2013 | |
| WO | 2016144799 | A1 | 9/2016 | |
| WO | 2016156454 | A1 | 10/2016 | |
| WO | 2016184799 | A1 | 11/2016 | |
| WO | 2017115009 | A1 | 7/2017 | |
| WO | 2017162921 | A1 | 9/2017 | |
| WO | 2017220662 | A1 | 12/2017 | |
| WO | WO-2018229343 | A1 * | 12/2018 | B65D 65/42 |

OTHER PUBLICATIONS

Notification of the Third Office Action and English translation thereof in corresponding Chinese application 2019800334380 issued on Mar. 20, 2023; 17 pages.
Wang, Zhonghou; Pulp and Papermaking Process (2nd Edition) Light Industry Press 2008. p. 293.
An, Yuqin; Pulp and Papermaking Aids, China Light Industry Press, Feb. 2010, pp. 303 and 304.
Zirconium and Hafnium in China, China Coloured Metal Industry Association, p. 53, Metallurgical Industry Press, Apr. 2014.
Search Report from National Intellectual Property Administration PRC for application 2019800334380 and English Translation thereof; dated Oct. 28, 2022.
Search report of corresponding Chinese application CN201980033438.0 on Mar. 30, 2022; 2 pages.

* cited by examiner

*Primary Examiner* — Alicia J Weydemeyer
*Assistant Examiner* — Laura B Figg
(74) *Attorney, Agent, or Firm* — Meunier Carlin & Curfman LLC

(57) ABSTRACT

A coating structure for a sheet-like substrate is disclosed including cellulosic fibres and a sheet-like product. The structure includes at least one pre-coat layer and a top coat layer, where the pre-coat layer(s) and the top coat layer include 10-90 weight-% of a styrene (meth)acrylate copolymer which is polymerised in the presence of a stabiliser, and which has a glass transition temperature Tg≤20° C., preferably ≤15° C., more preferably ≤13° C. Furthermore, the pre-coat layer(s) includes a polysaccharide, such as starch, and the top coat layer includes 5-60 weight-% of at least one water-soluble coating binder, which is selected from polysaccharides and polyvinyl alcohols, as well as at most 5.0 weight-% of a cross-linker, which reacts with —OH or —COOH groups.

19 Claims, No Drawings

COATING STRUCTURE, SHEET-LIKE PRODUCT AND ITS USE

PRIORITY

This application is a U.S. national application of the international application number PCT/FI2019/050478 filed on Jun. 19, 2019 and claiming priority of FI application number 20185555 filed on Jun. 20, 2018, the contents of all of which are incorporated herein by reference.

The present invention relates to a barrier coating structure, a sheet-like product and use of the product according to the preambles of the enclosed independent claims.

Various coatings can be applied on the surface of paper or board in order to improve their properties. Grease barrier and water vapour barrier properties are particularly important for paper and board that are used for products for packaging purposes. Coatings applied on the surface of paper or board should provide an effective barrier for leakage from the goods inside the package and/or protect the packaged goods from contamination and/or contact with the surrounding atmosphere. For packaging materials used for foodstuff and consumable liquids the barrier requirements are especially stringent.

Coatings for packaging purposes should also have good resistance for creasing and folding. The coating should not crack when the paper or board is folded into a box or wrapped around the product. Cracking may decrease or even completely destroy the barrier properties of the coating.

Furthermore, paper and board coatings should be resistant for blocking during the product manufacturing and converting processes. If the coating layer softens under high pressure and high temperature it may adhere after rewinding to the next layer on the reel and block the whole reel when cooled down. During the converting process the coating should have suitable friction properties in order to run smoothly in the process. The coating should also have appropriate glueability, which determine the speed and strength of a bond generated by the application of an adhesive to the coating surface, in order to be used at high speed packing lines.

Conventionally fluorochemicals have been used in coating compositions to provide desired barrier properties with resistance to cracking. For environmental reason it would desirable to find effective alternatives for fluorochemicals.

Starch is commonly used in various surface coatings, for example in surface sizing. It can provide the coating barrier properties for example against moisture, and it is easily available and inexpensive to use. However, starch containing coatings are prone to cracking, and this disadvantage has limited the use of starch in more demanding applications.

The coatings used for packages should also satisfy the recyclability requirements. Paper and board packages are ideally collected for recycling, i.e. repulping. The coating applied on these products should thus also fulfil the requirements of recycling and, for example, it should not disturb the repulping process. Traditional plastic films laminated on the surface of paper or board are not necessarily easily repulpable. Thus, laminated paper and board products often end up as energy waste, which is uneconomical in view of the resources.

An object of this invention is to minimise or possibly even eliminate the disadvantages existing in the prior art.

Another object of the present invention is to provide a barrier coating composition and a sheet-like product that provide good grease and water vapour barrier properties.

An object of the present invention is to provide a barrier coating composition, which can be used to create a coating that withstands cracking when creased and/or folded.

A further object of the present invention is to provide a barrier coating composition that is suitable for coating at high coating speeds and has good runnability.

These objects are attained with the invention having the characteristics presented below in the characterising parts of the independent claims. Some preferred embodiments of the invention are presented in the dependent claims.

The embodiments mentioned in this text relate, where applicable, to all aspects of the invention, even if this is not always separately mentioned.

A typical coating structure according to the present invention for a sheet-like substrate comprising cellulosic fibres, comprises at least one pre-coat layer and a top coat layer, where

- the pre-coat layer(s) and the top coat layer comprise 10-90 weight-% of a styrene (meth)acrylate copolymer which is polymerised in the presence of a stabiliser, and which has a glass transition temperature Tg≤20° C., preferably ≤15° C., more preferably ≤13° C.,
- the pre-coat layer(s) comprises a polysaccharide, such as starch, and
- the top coat layer comprises
  - 5-60 weight-% of at least one water-soluble coating binder, which selected from polysaccharides and polyvinyl alcohols, as well as
  - at the most 5.0 weight-% of a cross-linker, which reacts with —OH or —COOH groups.

A typical sheet-like product according to the present invention comprises

- a substrate comprising cellulosic fibres, and having a first and second parallel large surface, and
- a coating structure according to the present invention, applied on at least one the large surfaces of the substrate.

Now it has been surprisingly found out that the well-defined pre-coat layer and top-coat layer, which comprise copolymer of styrene (meth)acrylate, provides good resistance for cracking, even when one or both of the layers contain polysaccharide, such as starch. Use of polysaccharide, such as starch, makes the coating structure more economic and environmentally benign as the use of synthetic polymers in the structure may be reduced. The substrate coated with the coating structure can be subjected to folding during manufacture of package without cracking, and it also provides good barrier against grease and/or moisture.

In the present context, all weight-% values given for the various components in the coating layers and coating composition are calculated from the total dry solids content of the coating layer or composition.

The coating structure according to the present invention comprises at least one pre-coat layer and a top coat layer. Pre-coat layer is applied on the surface of a sheet-like substrate comprising cellulosic and/or lignocellulosic fibres. In some embodiments the surface of the sheet-like structure may be surface-sized, e.g. with hydrophobic surface size, before application of the pre-coat layer, but preferably the pre-coat layer is applied directly on the surface of a sheet-like substrate which is free from any pre-existing treatment layers. The substrate may comprise an internal size.

According to one embodiment of the invention the coating structure may comprise two or more pre-coat layers and one or more top-coat layer(s), which is/are applied on the outermost pre-coat layer. Preferably the coating structure may comprise two or more pre-coat layers and one top-coat layer, which is applied on the outermost pre-coat layer. The individual pre-coat layers may be different from each other or identical to each other. By using a plurality of pre-coat and/or to coat layers it is possible to tailor the barrier properties of the coating structure by using different layers and/or use lighter individual layers. According to one embodiment the coating structure comprises one pre-coat layer and one top-coat layer.

The pre-coat layer(s) and the top coat layer(s) comprise 10-90 weight-% of a styrene (meth)acrylate copolymer which is polymerised in the presence of a stabiliser, and which has a glass transition temperature Tg≤20° C., preferably ≤15° C., more preferably ≤13° C., sometimes even ≤10° C. This means that each precoat layer and/or each top coat layer may comprise 10-90 weight-% of a styrene (meth)acrylate copolymer. According to one embodiment of the invention the pre-coat layer(s) may comprise 20-80 weight-%, preferably 30-70 weight-%, more preferably 40-60 weight-%, of styrene (meth)acrylate copolymer. It is also possible that each pre-coat layer may comprise 10-70 weight-%, preferably 15-50 weight-%, more preferably 40-60 weight-%, of styrene (meth)acrylate copolymer. The top coat layer(s) may comprise 35-90 weight-%, preferably 35-70 weight-%, more preferably 40-60 weight-%, of styrene (meth)acrylate copolymer. The amounts indicate again the amount of copolymer in each individual layer. According to one preferable embodiment the amount of styrene acrylate copolymer is higher in the top coat layer(s) than in the pre-coat layer(s).

The styrene (meth)acrylate copolymer, which is suitable for use in the present invention, may be obtained by free radical emulsion copolymerisation of at least monomer (a), monomer (b) and an optional monomer (c) in the presence of a stabiliser, wherein monomer (a) is at least one optionally substituted styrene and monomer (b) is at least one C1-C4-alkyl (meth)acrylate. The styrene (meth)acrylate copolymer may have a weight average molecular weight MW<100 000 g/mol, preferably <75 000 g/mol. The styrene (meth)acrylate copolymer may have a weight average molecular weight MW in the range of 5000-95 000 g/mol, preferably 10 000-70 000 g/mol.

According to one preferable embodiment the monomer (a) of the styrene (meth)acrylate copolymer is selected from group comprising styrene, substituted styrenes, such as α-methylstyrene, vinyltoluene, ethylvinyltoluene, chloromethylstyrene, and any mixtures thereof. The amount of monomer (a) may be 0.1-75 weight-%, preferably 5-60 weight-%, more preferably 10-55 weight-%, calculated from the total dry solids content of the monomers (a), (b) and optional (c).

Suitable monomer (b) of the styrene (meth)acrylate copolymer may be selected from group consisting of C1-C4-alkyl acrylates; C1-C4-alkyl methacrylates; or their mixtures, e.g. n-butyl, iso-butyl, tert-butyl or 2-butyl acrylate and the corresponding butyl methacrylates; methyl acrylate, methyl methacrylate, ethyl acrylate, ethyl methacrylate, propyl acrylate or propyl methacrylate. According to one preferable embodiment of the invention the monomer (b) is selected from butyl (meth)acrylates. It can comprise, for example, a mixture of at least two isomeric butyl acrylates. More preferably, the monomer component (b) is n-butyl acrylate, tert-butyl acrylate or a mixture of n-butyl acrylate and tert-butyl acrylate. The amount of monomer (b) may be 25-99.9 weight-%, preferably 30-95 weight-%, more preferably 35-90 weight-%, calculated from the total dry solids content of the monomers (a), (b) and optional (c).

According to one embodiment the styrene (meth)acrylate copolymer originates also at least from one optional monomer (c), which is ethylenically unsaturated and different from monomers (a) and (b). Preferably the styrene (meth) acrylate copolymer is a carboxylated copolymer, preferably obtained by polymerising the above described monomers (a) and (b) with monomer (c), which is selected from carboxylic acids, such as acrylic acid, methacrylic acid, itaconic acid, maleic acid or styrene sulphonic acid. Acrylic acid and styrene sulphonic acid are being preferred as optional monomer (c). The amount of the optional monomer (c) may be 0.1-15 weight-%, preferably 0.1-10 weight-%, more preferably 1-5 weight-%, calculated from the total dry solids content of the monomers (a), (b) and (c). More preferably the styrene (meth)acrylate copolymer is carboxylated copolymer, preferably obtained by polymerizing monomer mixture comprising 1-5 weight-% of carboxylic acid.

According to one embodiment of the invention the styrene (meth)acrylate copolymer is polymerised in the presence of a stabiliser, which is selected from polysaccharide or polyvinyl alcohol. Polysaccharide may be starch or it may be selected from any polysaccharide, which contains a free hydroxyl group, such as amylose, amylopectine, carrageen, cellulose, chitosan, chitin, dextrines, guar gum (guarane) and other galactomannans, arabic gum, hemicellulose components, and pullulan. Preferably stabiliser is starch, even more preferably degraded starch. According to one preferable embodiment the stabilizer is degraded starch having average molecular weight Mn from 500 to 10 000 Da. Degraded starch may be obtained by subjecting starch to oxidative, thermal, acidic, hydrolytic or enzymatic degradation. The oxidative degradation is presently being preferred. Hypochlorite, peroxodisulphate, hydrogen peroxide or their mixtures may be used as oxidising agents. Degraded starch, which is suitable for used in the present invention, may be any suitable degraded natural starch, such as potato, rice, corn, waxy corn, wheat, barley or tapioca starch. Starches having an amylopectin content >80%, preferably >95%, are advantageous.

The polymerisation of the styrene (meth)acrylate copolymer may be carried out by addition of the above described monomers, either individually or as a mixture, and free radical initiator(s) suitable for initiating the polymerisation, to the aqueous stabiliser solution. The polymerisation process is typically carried in the absence of oxygen, preferably in an inert gas atmosphere, for example under nitrogen. According to one embodiment of the invention the total amount of monomers in the reaction mixture is 10-92 weight-%, preferably 20-90 weight-%, more preferably 35-88 weight-%, calculated from the total dry solids content of the reaction mixture. The amount of monomers refers here to the total amount of monomers (a), (b) and optional (c), which are added to the reaction mixture during the polymerisation process.

The styrene (meth)acrylate copolymer may have a glass transition temperature in the range of −40-20° C., preferably −30-15° C., more preferably −20-13° C., even more preferably −10-13° C., sometimes even more preferably 0-13° C. or sometimes −10-10° C. These glass transition temperature ranges provide copolymers which show required barrier properties but are soft enough to withstand cracking when the substrate is creased or folded into a package.

According to one preferable embodiment of the invention that the styrene (meth)acrylate copolymer used in the pre-coat layer(s) and the styrene (meth)acrylate copolymer used in the top coat layer(s) are identical to each other.

In addition to styrene (meth)acrylate copolymer the pre-coat layer(s) comprises a polysaccharide, such as starch. According to one embodiment of the invention the pre-coat layer(s) may comprise 10-90 weight-%, preferably 20-80 weight-%, more preferably 30-70 weight-%, even more preferably 40-60 weight-%, of polysaccharide. It is possible that each pre-coat layer comprises 30-90 weight-%, preferably 50-85 weight-%, more preferably 40-60 weight-%, of polysaccharide. The amounts indicate the amount of polysaccharide in each individual pre-coat layer. Polysaccharide may be selected from starch, carrageen, chitosan, chitin, dextrines, guar gum (guarane) and other galactomannans, arabic gum. According to one preferable embodiment the polysaccharide in the pre-coat layer is starch, preferably degraded starch, more preferably degraded non-ionic or anionic starch, more preferably degraded anionic starch. According to one embodiment the anionic starch has a viscosity below 100 mPas, measured at 10% solids, at 60° C., with Brookfield 100.

The top coat layer(s) may comprise 30 weight-%, preferably <27 weight-%, more preferably <25 weight-%, sometimes even <20 weight-%, of inorganic mineral pigment. The amount of inorganic mineral pigment may be, for example, in the range of 0.1-30 weight-%, preferably 0.1-27 weight-%, preferably 0.1-25 weight-%. The amounts indicate the amount of inorganic mineral pigment in each individual layer. The inorganic mineral pigment may be selected from kaolin, talc, calcium carbonate or any mixture thereof, preferably calcium carbonate, such as ground calcium carbonate or precipitated calcium carbonate. Addition of inorganic mineral pigment may improve the obtained barrier properties, while providing economic benefits, such as reduced amount of polymer components. Alternatively the top coat layer may be free of inorganic mineral pigment.

The pre-coat layer may be free of inorganic mineral pigment.

The top coat layer of the coating structure may further comprise at least one water-soluble coating binder, which selected from polysaccharides and polyvinyl alcohols. The amount of water-soluble coating binder in the top coat layer may be 5-60 weight-%, preferably 10-60 weight-%, sometimes 15-55 weight-%.

According to one embodiment of the invention the top coat layer may comprise water-soluble coating binder, which is polyvinyl alcohol that preferably has a weight average molecular weight of ≤50 000 g/mol, preferably 13 000-50 000 g/mol. Preferably polyvinyl alcohol may be at least partially hydrolyzed, preferably with a hydrolysis degree of at least 30%, more preferably 85-98%. As water soluble polymer polyvinyl alcohol improves the film formation and thus improves both water vapour and mineral oil barrier properties. It also reduces blocking tendency.

According to another embodiment the water-soluble coating binder in the top coat layer may be polysaccharide. Examples of suitable polysaccharides are starch, starch, carrageen, chitosan, chitin, dextrines, guar gum (guarane) and other galactomannans, arabic gum. The water-soluble coating binder is preferably degraded starch or dextrin. According to one preferable embodiment coating binder is polysaccharide, which is anionic or non-ionic starch, preferably degraded anionic starch.

The top coat layer of the coating structure further comprises at the most 5.0 weight-%, preferably at the most 3.0 weight-%, of a cross-linker, which reacts with —OH or —COOH groups. According to one embodiment of the invention the top coat layer may comprise the cross-linker in amount of 0.1-5 weight-%, preferably 0.1-4 weight-%, more preferably 0.5-3 weight-%. The cross-linker is preferably selected from ammonium zirconium carbonate, potassium zirconium carbonate, glyoxal or citric acid. Cross-linkers make the top coat layer less sensitive for water, e.g. by reducing the number of end groups available for reactions with water. Cross-linker may also improve the repulping properties of the final produced coating structure.

According to one embodiment of the invention the coating structure may comprise a polyethylene film, which is applied on the top coat layer. Polyethylene film provides improved barrier properties, especially when the coating structure is applied on a substrate intended for liquid packaging.

According to another embodiment of the present invention the coating structure is free from any layers of laminated polymer films. This improves the repulpability of the coating structure.

The coating structure enables manufacture of various coatings, with different combinations of pre-coat layer(s) and top coat layer. The coat weights in the pre-coat layer and top coat layer can be freely chosen depending on the desired end use. According to one embodiment of the invention each pre-coat layer may have a coat weight of 0.5-6 g/m$^2$, preferably 1-5 g/m$^2$, more preferably 1-4 g/m$^2$, and the top coat layer has a coat weight of 1-10 g/m$^2$, preferably 2-8 g/m$^2$, more preferably 2-7 g/m$^2$.

The substrate which is coated with the barrier coating composition is preferably a substrate comprising cellulosic and/or lignocellulosic fibres. The cellulosic or lignocellulosic fibres may have been obtained by any conventional pulping process, including chemical, mechanical, chemimechanical pulping processes. The fibres may also be recycled fibres. The substrate has a first and second parallel large surface, and it is usually in form of a fibrous web. The substrate may have a grammage of 25-800 g/m$^2$, preferably 30-700 g/m$^2$, more preferably 40-500 g/m$^2$.

The layers of the coating structure may be applied on at least one the large surfaces of the substrate by using any conventional coating techniques, such as rod coating, blade coating, spray coating or curtain coating.

According to one preferable embodiment the obtained coated product has TAPPI 559 KIT test value of at least 8, preferably 10, more preferably 12. The KIT test value measures the repellency of the coating to oil and grease and the measurements are performed according to standard TAPPI method T-559 pm-96.

According to one preferable embodiment the obtained coated product has a mineral oil barrier HVTR value <100 g/m$^2$/d. The used Hexane Vapour Transmission Rate (HVTR) value is obtained by using cup test method developed by BASF. In the test hexane is placed in a measurement cup covered by barrier sample, and the evaporation of hexane through the known area is measured. The test method is commonly known for persons skilled in the art.

According to one preferable embodiment the obtained coated product has a water vapour barrier at 23° C. and 50% relative humidity WVTR value <100 g/m$^2$/d. WVTR value can be measured by using standard methods of ASTM F-1249, ISO 15105-2, ISO 15106-3, DIN 53122-2.

The sheet-like product can be used for making a foodservice package or for liquid packaging. Typical examples of foodservice packages are packages for fast food, ready-to-eat meals, sandwiches, bakery products, such as cookies, doughnuts, or the like.

EXPERIMENTAL

Some embodiments of the invention are described in the following non-limiting examples.

Methods and Materials

Coating tests were carried out using K control coater draw down coater and different wound rods. Coat weight was determined by weighting the coated samples and uncoated base papers and coat weight was obtained by the weight difference. Creasing tests were done using Cyklos CPM 450 unit. Creasing and folding was done in machine and cross directions. Staining test was done for the creased samples by using methyl red dissolved in ethanol. For folding, Cobb roller was used to give uniform folding pressure.

Water resistance was tested using Cobb300 test. Water vapor barrier properties were measured using Systech Permeation Analyzers M7002 instrument. Hexane vapor transmission rate was determined by using a cup method. 20 grams of hexane was placed in a metal cup. Barrier sample was placed on top of the cup between two gaskets, coated side down. Metal frame was used to tighten the sample to the cup. Weight loss was recorded for 24 hours. Grease barrier properties were tested using KIT test.

In all examples the used styrene acrylate copolymers had glass transition temperature of 10° C. and the substrate was virgin fiber cartonboard with basis weight of 295 g/m$^2$.

EXAMPLE 1

Used pre- and top coat formulations are given in Tables 1 and 2. Styrene acrylate copolymer has high carboxylation degree. Applied coat weight for the pre-coat formulation was 2.0 g/m$^2$.

TABLE 1

Tested coating formulations for pre-coat in example 1.

| | P2 (%) |
|---|---|
| Coating color starch | 80 |
| Styrene acrylate copolymer, Tg = 10° C., high carboxylation | 20 |

Starch was cooked at 10% solids.

TABLE 2

Tested coating formulation for top coat in example 1.

| | T3 (%) |
|---|---|
| Styrene acrylate copolymer, Tg = 10° C., high carboxylation | 47.5 |
| Fully hydrolyzed polyvinyl alcohol, Mw 47000 g/mol | 50 |
| Potassium zirconium carbonate | 2.5 |

TABLE 3

Test results for coating formulations in example 1.

| Tested coatings (pre-coat/top coat) | Total coat weight (g/m$^2$) | KIT | WVTR (g/m$^2$ * d) |
|---|---|---|---|
| P2 + T3 | 6.9 | 8 | 61 |
| P2 + T3 | 9.1 | 9 | 54 |

It can be seen from results in Table 3 that the created coating structure provided good barrier properties.

Example 2

Used pre- and top coat formulations are given in Tables 4 and 5. Styrene acrylate copolymer has low carboxylation degree. Applied coat weight for pre-coat formulation P3c was 2.4 g/m$^2$.

TABLE 4

Tested coating formulations for pre-coat in example 2.

| | P3c (%) | Pre 4 |
|---|---|---|
| Coating color starch | 60 | 40 |
| Styrene acrylate copolymer, Tg = 10° C., low carboxylation | 40 | 60 |

TABLE 5

Tested coating formulations for top coat in example 2.

| | T3c (%) | T4b (%) | T5 (%) | T6 (%) | T7 (%) |
|---|---|---|---|---|---|
| Styrene acrylate copolymer, Tg = 10° C., low carboxylation | 47.5 | 47.5 | 47.5 | 47.5 | 47.5 |
| Fully hydrolyzed polyvinyl alcohol, Mw 47000 g/mol | 50 | 30 | | | |
| Partially hydrolyzed polyvinyl alcohol, Mw 47000 g/mol | | | 30 | 20 | 30 |
| Coating colour starch | | | 20 | 10 | |
| Potassium zirconium carbonate | 2.5 | 2.5 | 2.5 | 2.5 | 2.5 |
| Coarse ground calcium carbonate | | 20 | | 20 | 20 |

TABLE 6

Test results for coating formulations in example 2.

| Tested coatings (pre-coat + top coat) | Total Coat weight (g/m$^2$) | KIT | Cobb300 (g/m$^2$) | WVTR (g/m$^2$ * d) | HVTR (g/m$^2$ * d) |
|---|---|---|---|---|---|
| P3c + T3c | 8.0 | 10 | — | 61.2 | 25 |
| P3c + T4b | 10.3 | 10 | 57 | — | — |
| P3c + T7 | 8.6 | 11 | — | — | 16 |
| P4 + P4 | 10.0 | 12 | — | — | 78 |
| P4 + T5 | 7.1 | 12 | — | — | 45 |
| P4 + T6 | 8.7 | 11 | — | — | 16 |

It is seen from Table 6 that improved KIT values were obtained as well as good hexane vapor and water vapor results.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A coating structure for a sheet-like substrate having a first and a second parallel major surfaces, and comprising cellulosic fibres, the structure comprising at least one pre-coat layer and a top-coat layer, where:

the pre-coat layer(s) and the top-coat layer comprise a styrene (meth)acrylate copolymer which is polymerized in the presence of a stabilizer, and which has a glass transition temperature Tg≤20° C., wherein the pre-coat layer(s) comprises:

15-50 weight-% of said styrene (meth)acrylate copolymer, and 50-85 weight-% of a polysaccharide, and the top-coat layer comprises:

10-90 weight-% of said styrene (meth)acrylate copolymer, and 5-60 weight-% of at least one water-soluble coating binder, which is selected from polysaccharides and polyvinyl alcohols, and at most 5.0 weight-% of a cross-linker, which reacts with —OH or —COOH groups.

2. The coating structure according to claim 1, wherein the top-coat layer comprises ≤30 weight-% of an inorganic mineral pigment.

3. The coating structure according to claim 2, wherein the inorganic mineral pigment is selected from kaolin, talc, calcium carbonate or any mixture thereof.

4. The coating structure according to claim 1, wherein the styrene (meth)acrylate copolymer has a glass transition temperature in a range of −40-20° C..

5. The coating structure according to claim 1, wherein the stabilizer is starch or polyvinyl alcohol.

6. The coating structure according to claim 1, wherein the styrene (meth)acrylate copolymer has a weight average molecular weight <100.000 g/mol.

7. The coating structure according to claim 1, wherein the styrene (meth)acrylate copolymer is a carboxylated copolymer.

8. The coating structure according to claim 1, wherein the top-coat layer comprises the cross-linker in an amount of 0.1-5 weight-%.

9. The coating structure according to claim 1 wherein the cross-linker in the top-coat layer is selected from ammonium zirconium carbonate, potassium zirconium carbonate, glyoxal or citric acid.

10. The coating structure according to claim 1, wherein the coating binder in the top-coat layer is polyvinyl alcohol.

11. The coating structure according to claim 1, wherein the coating binder in the top-coat layer is starch.

12. The coating structure according to claim 1, wherein the polysaccharide in the pre-coat layer is anionic or non-ionic starch.

13. The coating structure according to claim 1, wherein the styrene (meth)acrylate copolymers in the pre-coat layer(s) and the top-coat layer are identical to each other.

14. The coating structure according to claim 1, wherein the structure comprises two or more pre-coat layers and one top-coat layer, which is applied on the outermost pre-coat layer.

15. The coating structure according to claim 1, wherein each pre-coat layer has a coat weight of 0.5-6 g/m$^2$, p, and the top-coat layer has a coat weight of 1-10 g/m$^2$.

16. The coating structure according to claim 1, wherein the amount of styrene acrylate copolymer is higher in the top-coat layer than in the pre-coat layer(s).

17. A sheet-like product comprising:

a substrate comprising cellulosic fibres, and having a first and a second parallel major surface, and a coating structure according to claim 1 applied on at least one of the large surfaces of the substrate.

18. The product according to claim 17, wherein the substrate has a grammage of 25-800 g/m$^2$.

19. The product according to claim 17, wherein the product has KIT test value of at least 8, and/or mineral oil barrier HVTR value <100 g/m$^2$/d, and/or water vapour barrier WVTR value <100 g/rn$^2$/d.

* * * * *